US011732446B2

(12) United States Patent
Bartos

(10) Patent No.: US 11,732,446 B2
(45) Date of Patent: Aug. 22, 2023

(54) PLUMBING DISTRIBUTION AND CONTROL PANEL SYSTEM

(71) Applicant: Tomas Bartos, Roselle, IL (US)

(72) Inventor: Tomas Bartos, Roselle, IL (US)

(73) Assignee: POSEIDON TECHNOLOGY CORP., Chicago, IL (US)

( * ) Notice: Subject to any disclaimer, the term of this patent is extended or adjusted under 35 U.S.C. 154(b) by 0 days.

(21) Appl. No.: 17/665,274

(22) Filed: Feb. 4, 2022

(65) Prior Publication Data

US 2022/0243431 A1 Aug. 4, 2022

Related U.S. Application Data

(60) Provisional application No. 63/145,960, filed on Feb. 4, 2021.

(51) Int. Cl.

| | |
|---|---|
| ***E03B 7/07*** | (2006.01) |
| ***E03B 7/04*** | (2006.01) |
| ***E03B 7/00*** | (2006.01) |
| ***E03B 7/08*** | (2006.01) |
| ***E03B 7/09*** | (2006.01) |

(52) U.S. Cl.

CPC ..... *E03B 7/075* (2013.01); *E03B 7/003* (2013.01); *E03B 7/04* (2013.01); *E03B 7/071* (2013.01); *E03B 7/08* (2013.01); *E03B 7/095* (2013.01); *Y10T 137/6969* (2015.04); *Y10T 137/7043* (2015.04); *Y10T 137/7062* (2015.04)

(58) Field of Classification Search

CPC ... E03B 7/04; E03B 7/07; E03B 7/071; E03B 7/078; E03B 7/08; E03B 7/09; E03B 7/095; Y10T 137/6969; Y10T 137/87877; Y10T 137/7043; Y10T 137/7062

See application file for complete search history.

(56) References Cited

U.S. PATENT DOCUMENTS

| | | | | |
|---|---|---|---|---|
| 5,438,714 A * | 8/1995 | Shaw | E03B 7/04 | 137/357 |
| 7,237,568 B2 * | 7/2007 | Cooper | A62C 37/50 | 137/382 |
| 7,267,138 B2 * | 9/2007 | Paradis | A47B 47/0066 | 312/265.6 |
| 10,604,917 B2 * | 3/2020 | Bartenstein | E03B 7/08 | |

(Continued)

FOREIGN PATENT DOCUMENTS

WO WO-2020073129 A1 * 4/2020 ..... B64D 11/02

*Primary Examiner* — Kevin F Murphy

(74) *Attorney, Agent, or Firm* — Justin Lampel

(57) ABSTRACT

A plumbing distribution and control panel system is provided. The plumbing distribution and control panel system has a main control panel unit having an interior. A portion of each of a plurality of pipes of a residence or commercial building may pass through the control panel to various zones of the building such as, for example, a water heater or tankless heater, a kitchen, a bathroom, a utility room, a laundry room, a basement, an exterior unit, or a mechanical room of a commercial building. The main control panel may allow a user to control the flow of water through the pipes in those zones. The main control panel allows for the easy cut-off of flowing water which may prevent damage to the residence or commercial building. A wireless system may also allow a user to wirelessly control the flow of water through the pipes.

11 Claims, 8 Drawing Sheets

(56) References Cited

U.S. PATENT DOCUMENTS

| | | | | |
|---|---|---|---|---|
| 10,895,068 | B1 * | 1/2021 | Capizzi | E03D 11/00 |
| 2015/0323412 | A1 * | 11/2015 | Stoltz | E03D 1/00 700/282 |
| 2019/0195374 | A1 * | 6/2019 | Carpenter | E03B 7/071 |

* cited by examiner

PLUMBING DISTRIBUTION AND CONTROL PANEL SYSTEM

CROSS REFERENCE TO RELATED APPLICATIONS

The following application is a based on and claims the priority benefit of U.S. provisional application Ser. No. 63/145,960 filed Feb. 4, 2021; the entire content of which is incorporated by reference.

BACKGROUND OF THE INVENTION

A plumbing distribution and control panel system is provided. The plumbing distribution and control panel system has a main control panel unit having an interior. A portion of each of a plurality of pipes of a residence or commercial building may pass through the control panel to various zones of the building such as, for example, a water heater or tankless heater, a kitchen, a bathroom, a utility room, a laundry room, a basement, an exterior unit, or a mechanical room of a commercial building. The main control panel may allow a user to control the flow of water through the pipes in those zones. The main control panel allows for the easy cut-off of flowing water which may prevent damage to the residence or commercial building. A wireless system may also allow a user to wirelessly control the flow of water through the pipes. A suction pump may further pull water back from the pipes into a holding reservoir or waste pipe drain.

Central areas in buildings for pipes are known. For example, U.S. Pat. No. 6,908,548 to Bruso discloses a prefabricated biological purification system for treatment of residential wastewater having a primary purification unit and a secondary purification unit containing a filling material having a grain size distribution of about 2 cm to about 4 cm in diameter. The primary purification unit having modular element forming a container, and internal elements including an inflow tube, an internal separation panel with a fluid passage duct defining a first internal sector and a second internal sector, a trapezoidal diaphragm, and a device for controlling liquid outflow. A second diaphragm in a form of an octagonal modular element is positioned within the container and a horizontal fluid passage duct is formed as a horizontal opening between portion of the internal separation panel and the second diaphragm. A flow control element forms an intake space between a bottom end portion of an outlet pipe and the trapezoidal diaphragm.

Further, U.S. Pat. No. 5,989,416 to Gorton discloses a filter bed base for the treatment of wastewater discharged from a dwelling, business or like producer. The filter bed base is generally rectangular in shape and includes an upper and lower surface. The upper surface of the filter bed base has a plurality of orifices for distributing filtered effluent into various chambers inside the base. The lower surface of the base has a plurality of orifices which are positioned beneath a select number of the chambers for discharging a portion of the filtered effluent into the soil underlying the base.

Still further, U.S. Pat. No. 5,645,367 to Gunter discloses a drainage system having a conduit connector which is integrally molded within a precast drainage system component in order to provide for the interconnection of a variety of drainage system components, such as drainage channel sections and catch basins. The conduit connector can include a connector body which defines an aperture of a predetermined shape and size which are selected to match and snugly engage the conduit. The connector body further includes at least one locking anchor to secure the connector body against movement relative to the precast component. The locking anchor can include a longitudinal movement resisting anchor and/or a rotational movement resisting anchor. In order to further secure the conduit connector within the precast component, the wall of the precast component is substantially continuous about the conduit connector. In addition, the connector body preferably has a predetermined thickness which is no greater than the thickness of the precast component walls. Accordingly, the conduit connector will not protrude outwardly beyond the precast component, thereby enabling the precast component to be readily transported and stored without incurring significant risk of breakage due to inadvertent contact of the conduit connector with another object.

However, these patents fail to describe a plumbing distribution and control panel system which is easy to use. Further, these patents fail to provide for a plumbing distribution and control panel system which allows a user to completely control and monitor all the plumbing activity within a residence or building.

SUMMARY OF THE INVENTION

A plumbing distribution and control panel system is provided. The plumbing distribution and control panel system has a main control panel unit having an interior. A portion of a plurality of pipes of a residence or commercial building may pass through the control panel to various zones of the building such as, for example, a water heater or tankless heater, a kitchen, a bathroom, a utility room, a laundry room, a basement, an exterior unit, or a mechanical room of a commercial building. The main control panel may allow a user to control the flow of water through the pipes in those zones. The main control panel allows for the easy cut-off of flowing water which may prevent damage to the residence or commercial building. A wireless system may also allow a user to wirelessly control the flow of water through the pipes. A suction pump may further pull water back from the pipes into a holding reservoir or waste pipe drain.

An advantage of the present plumbing distribution and control panel system is that the present system allows for monitoring and control of water distribution into specific zones within a building.

And an advantage of the present plumbing distribution and control panel system is that the present control panel and system allows for easy control of (such as the cutting-off of) water in the event of a leakage.

Still another advantage of the present plumbing distribution and control panel system is that the present system may allow the accurate measuring of water usage within a zone within a building.

And, an advantage of the present plumbing distribution and control panel system is that the system may have a sensor that may detect that water has not flowed through a specific zone of the building for a predetermined amount of time and may therein automatically flush water in that zone to prevent corrosion and/or disease.

Another advantage of the present plumbing distribution and control panel system is that a user may easily and quickly locate a shut-off valve for all pipes within a residence or building without the need to try and find a shut off valve located, for example, behind stored items under a bathroom sink. Further, a user may electively shut off the flow of water to multiple areas or the entire building or house at the same time.

Still another advantage of the present plumbing distribution and control panel system is that the present plumbing distribution and control panel system may have an automatic suction pump that automatically pulls water within a pipe back to a waste drain pipe in the event of an emergency shut-off.

Yet another advantage of the present plumbing distribution and control panel system is that the present plumbing distribution and control panel system may have a sensor that, when a leak is detected, automatically instructs the system to turn off the flow of water to the zone wherein the leak is detected and to automatically drain water from that zone.

And an advantage of the present plumbing distribution and control panel system is that the present system may prevent the buildup of sewer gas in toilets by adding water to the toilets if the toilets are not used for a predetermined period of time.

For a more complete understanding of the above listed features and advantages of the plumbing distribution and control panel system reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

Figure 1:
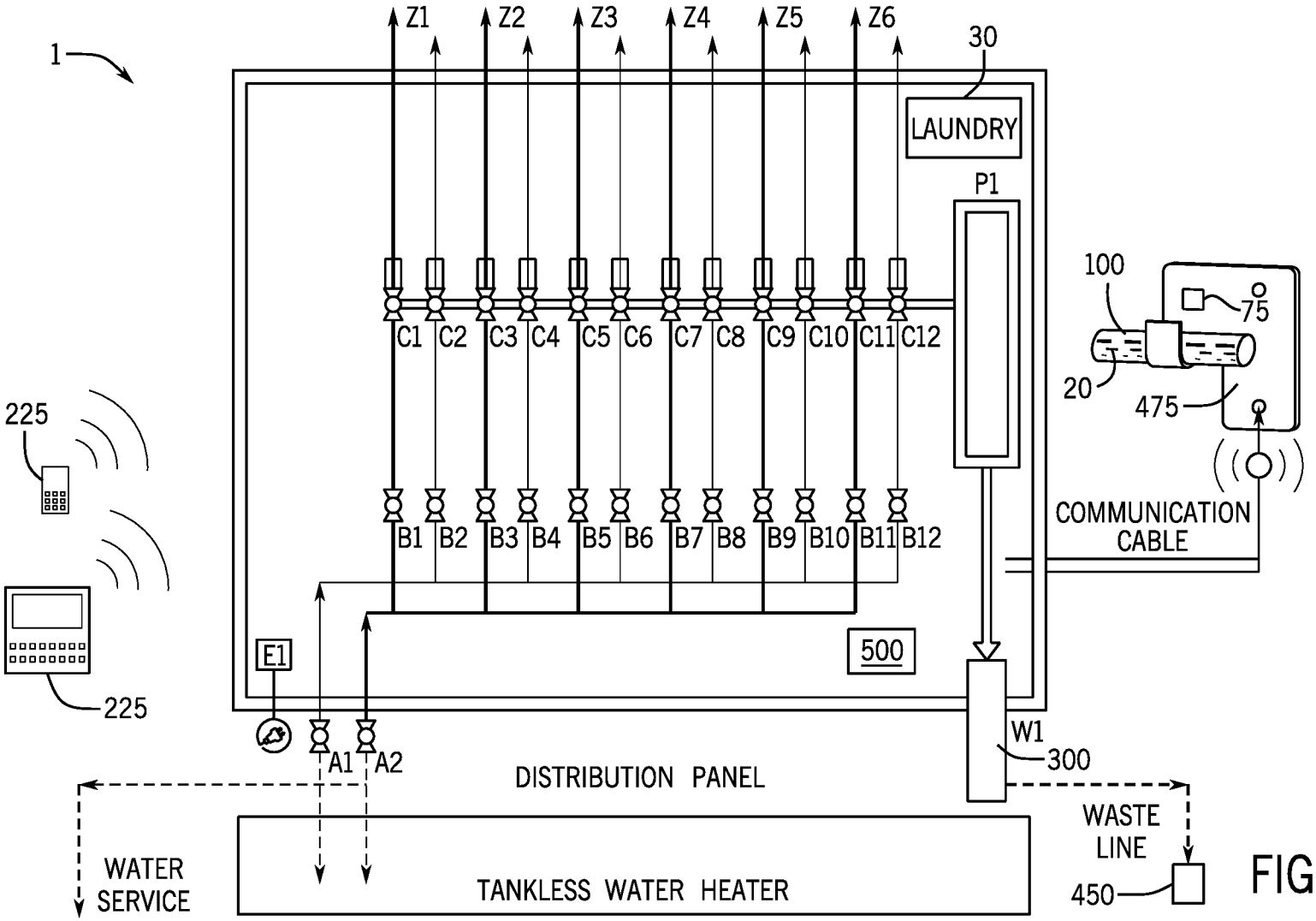
FIG. 1 illustrates a schematic of the plumbing distribution and control panel system in one embodiment.

A plumbing distribution and control panel system is provided. The plumbing distribution and control panel system has a main control panel unit having an interior. A portion of each of a plurality of pipes of a residence or commercial building may pass through the control panel to various zones of the building such as, for example, a water heater or tankless heater, a kitchen, a bathroom, a utility room, a laundry room, a basement, an exterior unit, or a mechanical room of a commercial building. The main control panel may allow a user to control the flow of water through the pipes in those zones. The main control panel allows for the easy cut-off of flowing water which may prevent damage to the residence or commercial building. A wireless system may also allow a user to wirelessly control the flow of water through the pipes. A suction pump may further pull water back from the pipes into a holding reservoir or waste pipe drain.

Referring now to the figures, a plumbing distribution/control panel system 1 is provided. The plumbing distribution and control panel system 1 may have a main control panel 10 (or "distribution panel") having a front door 320 and an interior 321. A central processing unit ("CPU" or first computer) 500 may be incorporated into the system 1. The front door 320 may protect someone from accidentally scalding themselves by touching a hot pipe. The front door 320 may electively have a lock 555 (to prevent unauthorized access) or may be produced without a locking mechanism. Within the interior 321 of the main control panel 10 may be a plurality of pipes 100. In particular, a small portion of, for example, a washing machine pipe system, may run through the control panel 10. The portion of each of the plurality of pipes 100 may each have its own associated valve 150 which allows for the immediate cut-off of flowing water 20 (or "liquid") within that pipe system 100. Depending on where the pipe goes within the building, the water 20 may be fresh water traveling to, for example, a faucet or other terminal location, or the water 20 may be grey or waste water 20.

The main panel 10 may have a plurality of indicia stickers or labels 30 which indicates specific zones ("locations") 50 in the building for which the pipes 100 may terminate or pass through. For example, one of the indicia stickers or labels 30 may state, by way of example only, "laundry room" referring to the pipe system passing through the control panel 10 and the laundry room of a residence or building. The number of zones 50 may vary a great deal and may be determined by the number of fixtures within the building. In an embodiment, the system may control various zones 50 within a building, as opposed to just controlling specific fixtures or elements. More specifically, in an embodiment, the control panel 10 may be used to control an entire bathroom, as opposed to one specific toilet within that bathroom. In one embodiment, each zone 50 is a different room of the building.

Each sticker or label 30 may be associated with a specific valve 150 so that a user may quickly control (shut off or turn on) the valve 150 associated with that specific zone 50 in the event of a leakage, emergency situation or for general repair and maintenance. As a result, a user need not scramble throughout a building to try to locate the shut-off valve 150 for a pipe 100 in each room as is commonly done in emergency situations like water leaks. More specifically, because all or substantially all of the (shut-off) valves 150 of the building are all centrally located within the central panel 10 of the system 1 of the building, a user need not try and scramble and find a shut-off valve 150 located behind stored items under, for example, a bathroom sink, in an emergency.

In an embodiment, a user may shut-off, for example, only one specific valve 150 therein cutting off water flow to one zone 50 only while leaving the other zones 50 of the building unaffected and still functional and able to move water. The user may close or open the valve 150 by, for example, pressing a button 400 located within the interior 321 of the control panel 10. The automatic or manual shut-off of water flow through a zone 50 may allow a user to leave the other zones 50 unaffected by the specific zone 50 shut-off.

Figure 2:
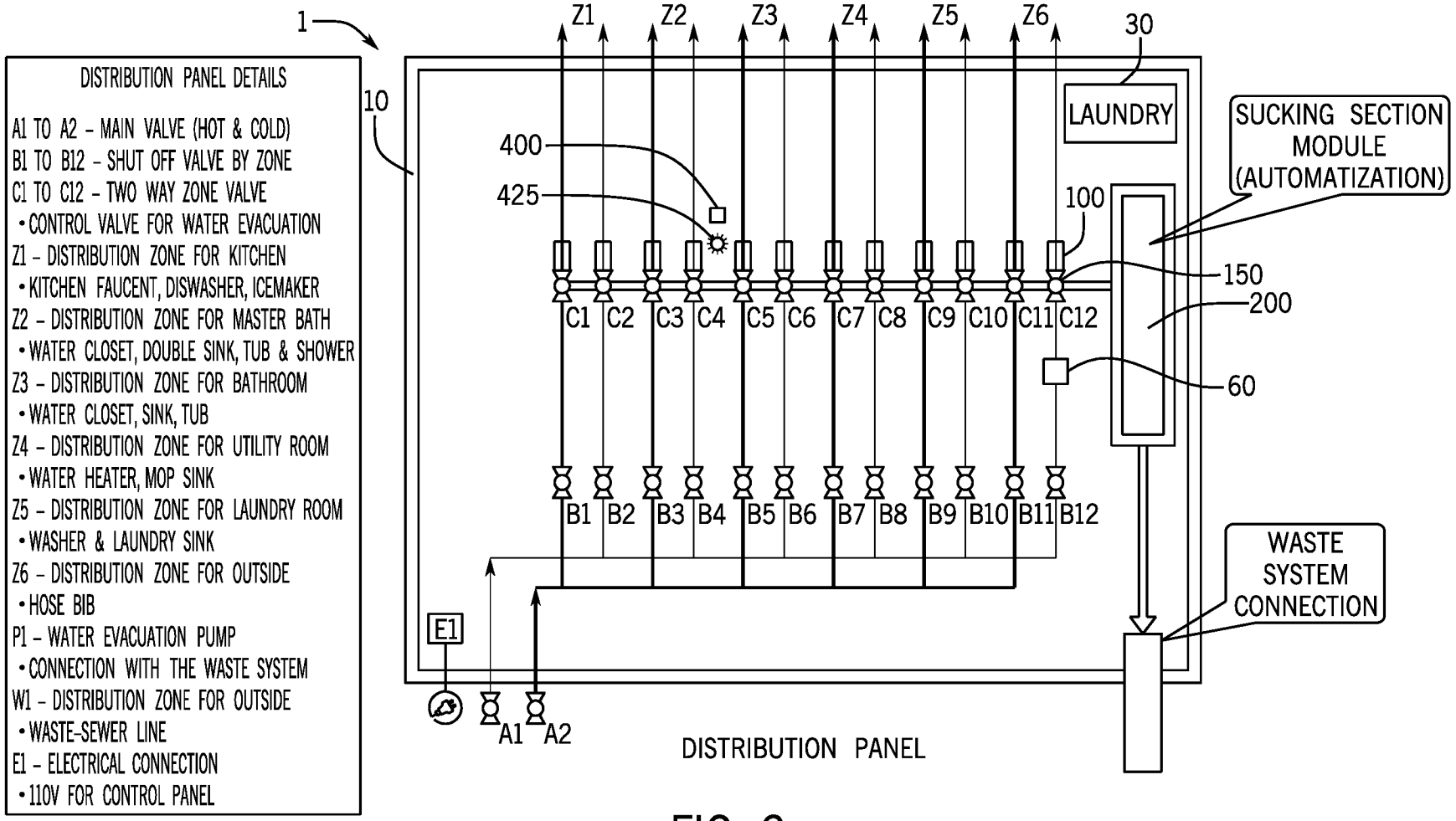
FIG. 2 illustrates a schematic of the plumbing distribution and control panel system in one embodiment.
Figure 3:
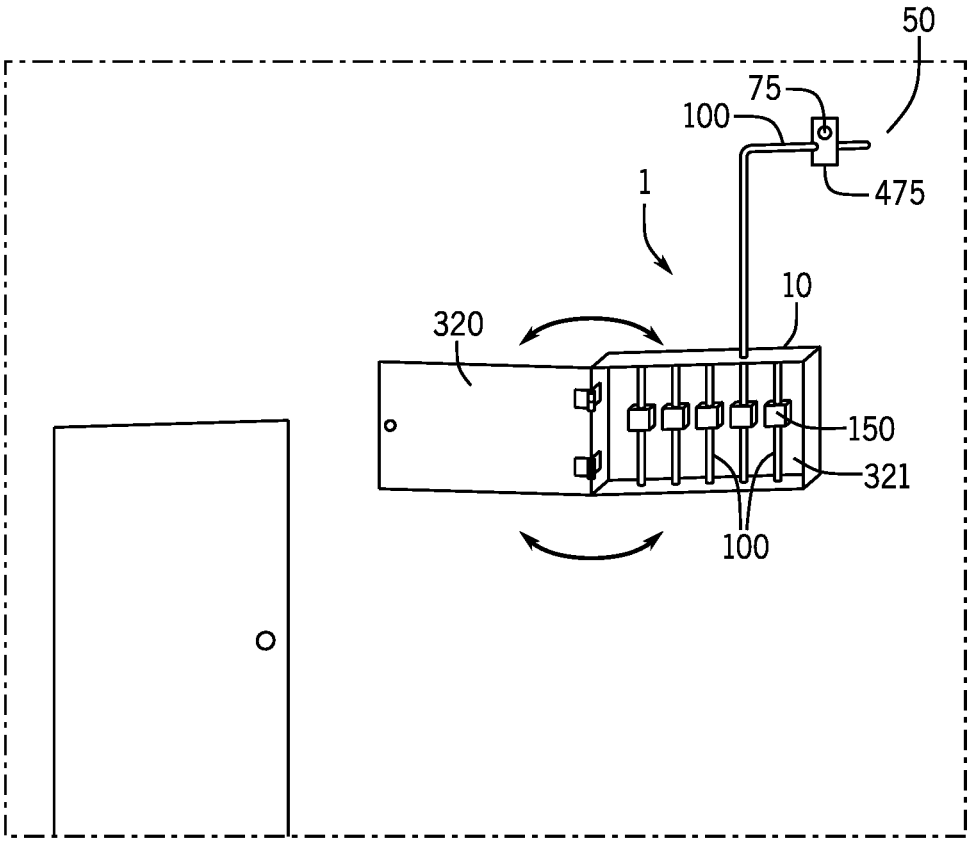
FIG. 3 illustrates a room having the control panel in the system.
Figure 4:
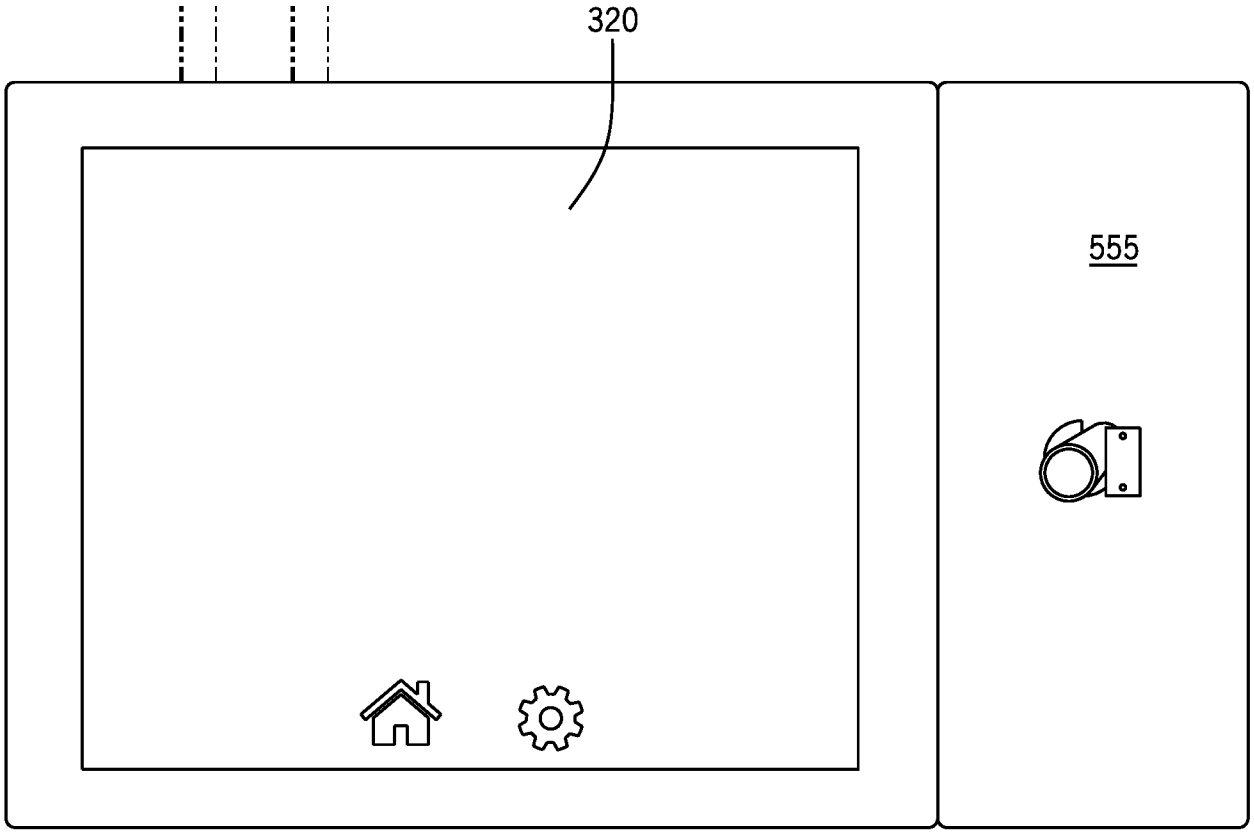
FIG. 4 illustrates the front door of the control panel in one embodiment.
Figure 5:
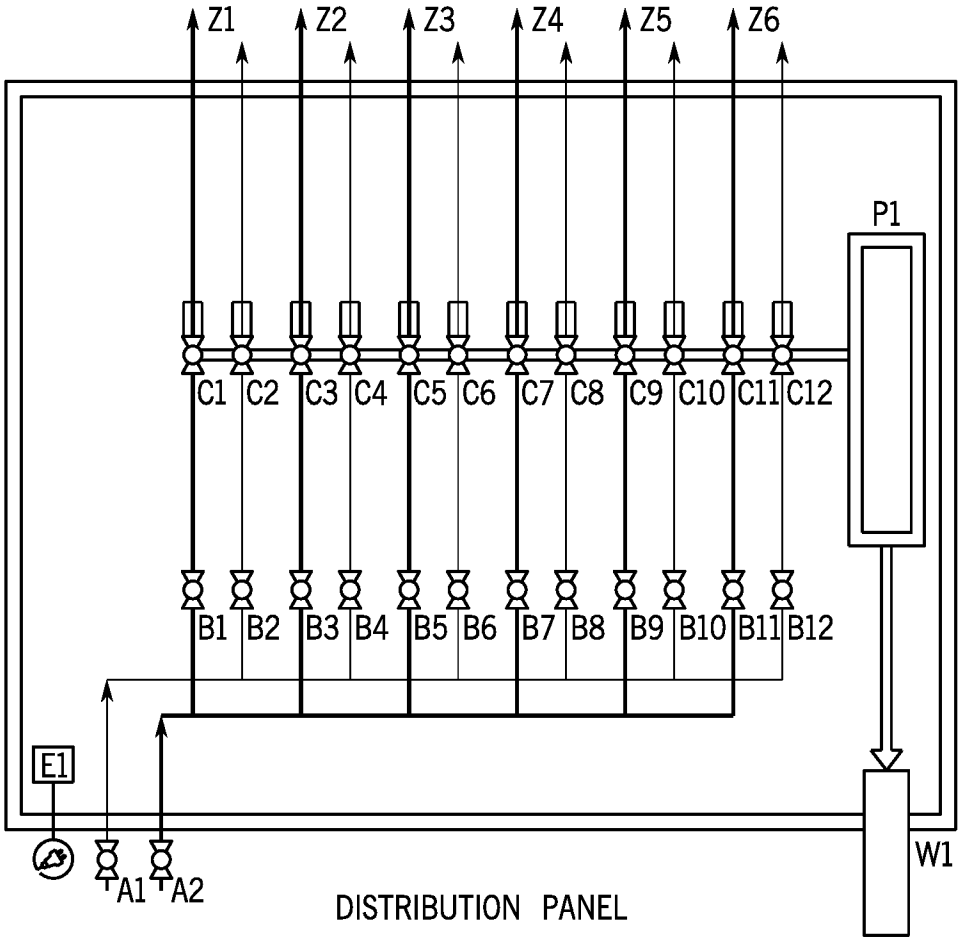
FIG. 5 illustrates an alternative embodiment of the control/distribution panel.
Figure 6:
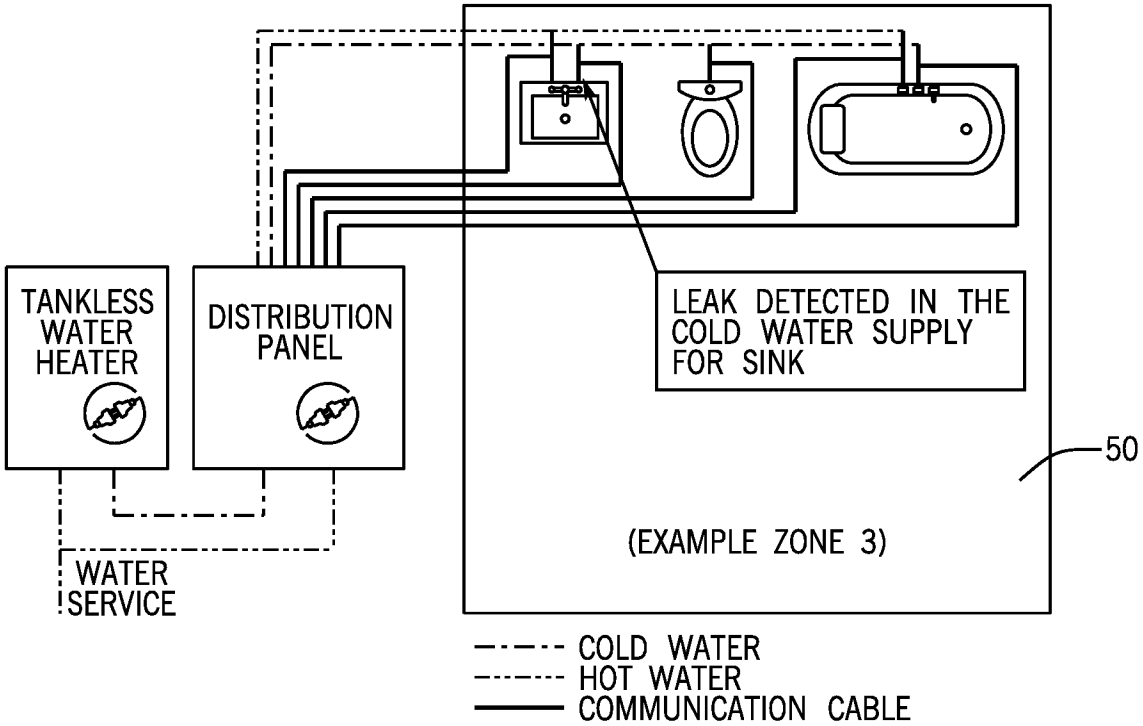
FIG. 6 illustrates the system in one embodiment wherein the panel, a tankless heater and a zone is illustrated.
Figure 7:
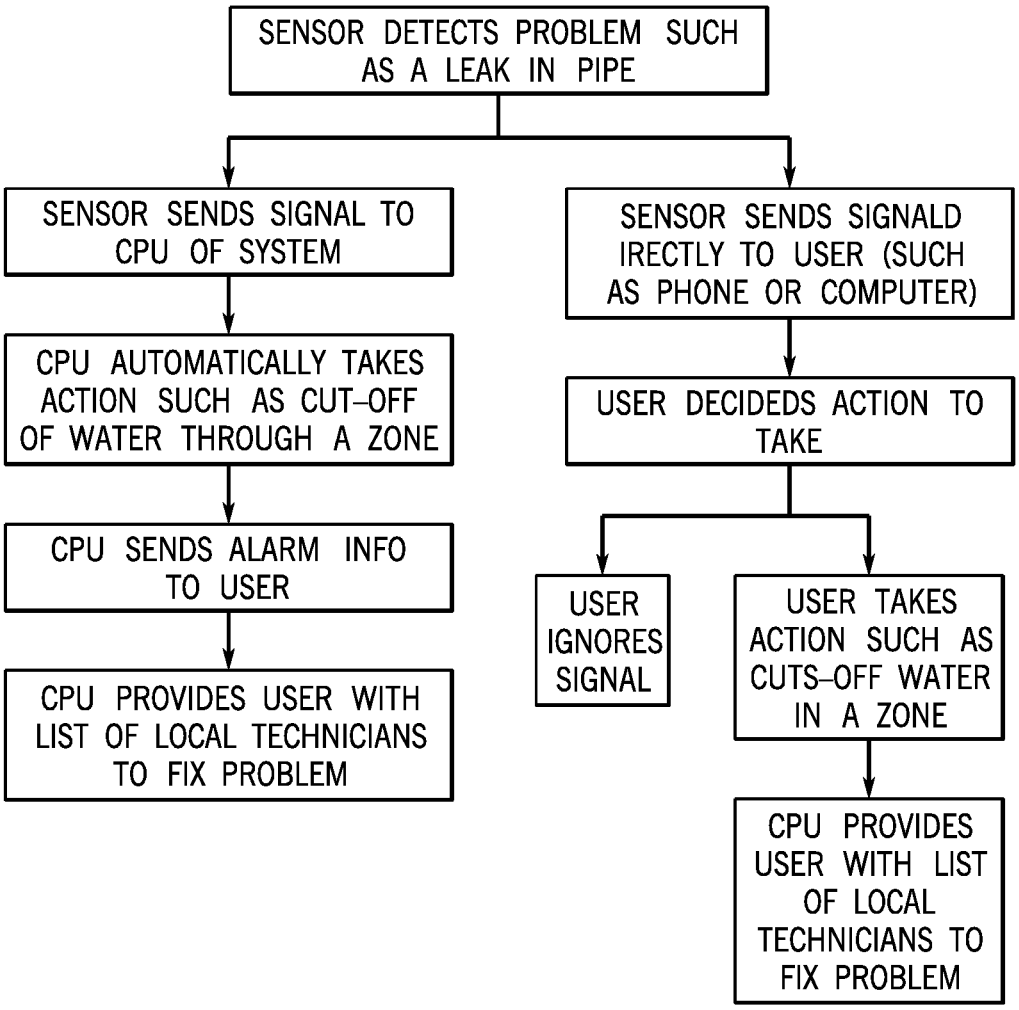
FIG. 7 illustrates the flow of information and action throughout the system in one embodiment.

In an embodiment, a light 425 located within the interior 321 of the control panel 10 may be associated with each zone 50. The light 425 may turn different colors such as, for example, red when a zone 50 is shut-off or green when water 20 is allowed to flow through that specific zone 50. FIG. 2 illustrates one button 400 and one light 425; however, it is understood that each pipe 100 passing through the control panel 10 would have its own activation button 400 and light 425.

In an embodiment, each of the plurality of pipes 100 may not only have a valve 150, but each of the plurality of pipes 100 may also be connected to a pump 200. The pump 200 may allow a user to pull or suck (or syphon) water 20 located within the pipes 100 (shown in FIG. 1) to a holding reservoir 300 located in the building or the pump 200 may discharge the water 20 into a waste drain area of the residence or building or may discharge the waste water 20 to community drainage systems out of the waste line 450.

In an embodiment, a water meter 60 may accurately measure the water usage within each of the zones 50 of the building. A sensor 75 may also be associated with each pipe 100. If excessive or abnormal water 20 usage is detected by the water meter 60 or sensor 75 the system may be triggered therein alerting a user of potential water hazard or damage. In an embodiment, the user (or operator) may even shut-off a valve 150 wirelessly or remotely through a second computerized device (such as a computer or phone) 225 upon receiving the alert. A user may even shut-off a valve 150 without receiving an alert to, for example, avoid water issues during construction or renovation of the building. The sensor 75 may be hard wired or may be wireless connected to the system 1. In one embodiment, the sensor 75 may be located in securing brackets 475 (such as the HAP SYSTEM® brackets, that secure the pipes 100 throughout the building.)

In an embodiment, the present plumbing distribution and control panel system 1 sensor 75 may further detect that water 20 has not flowed through a specific zone 50 of the building for a predetermined abnormal amount of time and may therein communicate to the system 1 to automatically flush water 20 in that zone 50 to prevent corrosion and/or disease such as legionnaires disease, which is caused by stagnate water. Still further, the sensor 75 may send a signal to the system's computer to automatically turn off the flow of water 20 through that zone 50 and will automatically drain that zone if a leak is detected.

In one embodiment, a sensor 75 may prevent the buildup of sewer gas. In particular, the present plumbing distribution and control panel system may prevent the buildup of sewer gas in toilets by adding water to the toilets if the toilets are not used for a predetermined period of time. For example, if the sensors 75 detect that a toilet water level falls below a predetermined level and is not flushed for a predetermined number of days the control panel will automatically add water to the toilet therein preventing sewer gas buildup.

In an embodiment, a user may install an app on his/her mobile phone 225 or may access a website on a computer 225 that allows the user to login in and control and monitor multiple buildings from a single device. In particular, a specific user may remotely control the flow of water 20 through one of his/her buildings while leaving a separate building under his/her control unchanged. Further, in one embodiment, a list of available local technicians may be automatically provided to the user via his/her mobile device or computer if a predetermined event occurs, such as an automatic shut-off due to a leakage.

Figure 8:
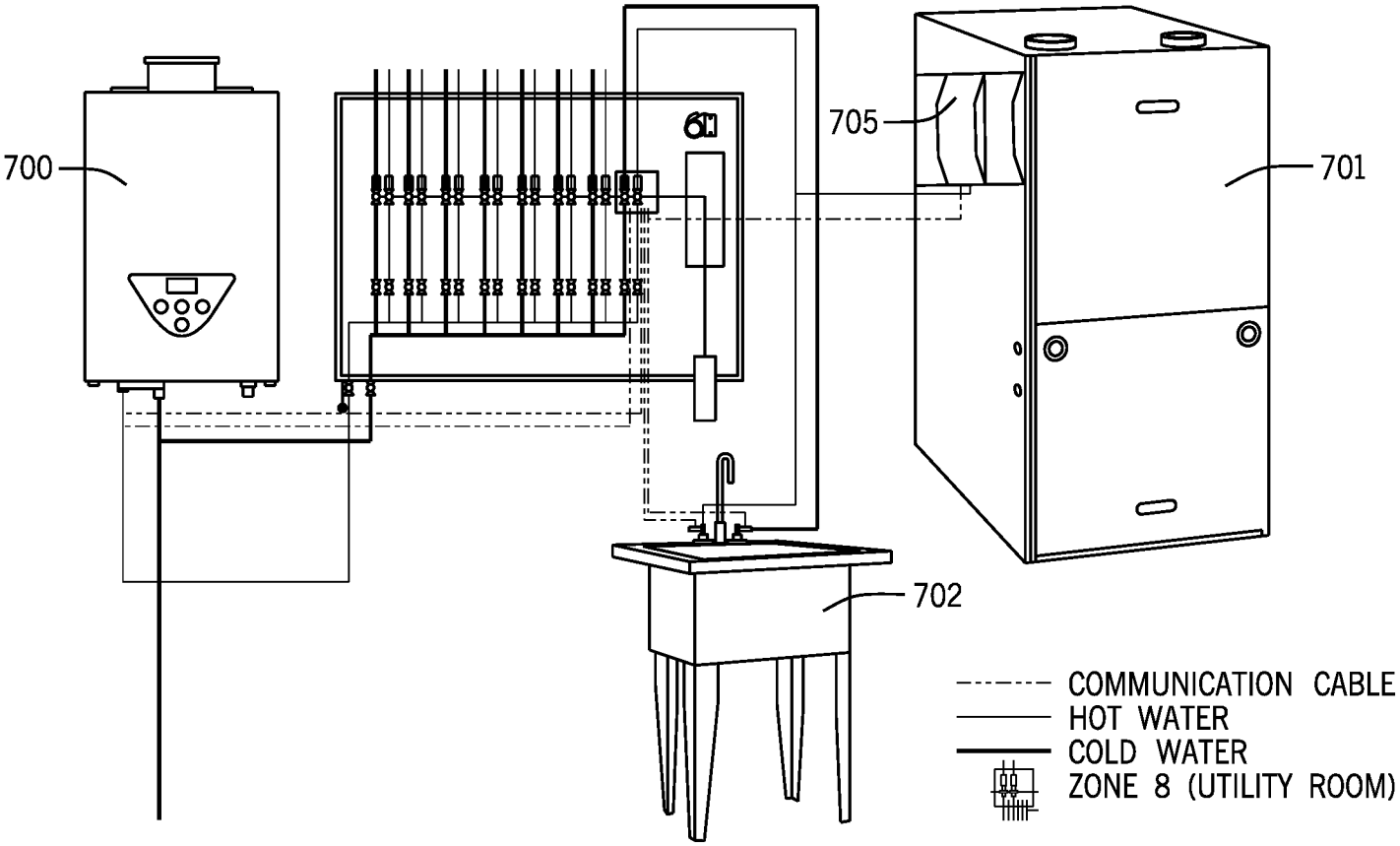
FIG. 8 is an illustration of the system, in one embodiment, wherein example zones/utilities are illustrated, such as a water heater.

In an embodiment, the control panel 10 may allow a user to control various zones and utilities of a building. As an example, "Zone 8" is shown in FIG. 8. In the present system, a user may use the control panel 10 to control a humidifier 705, a water circulation pump, a faucet 702 or outside spicket. In an embodiment, the humidifier 705 of the system may be connected with a hot water heater 700 of a furnace 701 of the system. The present system may be used to control the flow of the water 20 to the humidifier 705. In particular, the present system may use sensors 75 to detect if water 20 has not been used in certain zones 50 in the building for a predetermined set time. For example, the predetermined set time might be seventy-five percent that amount of time as is needed for legionnaires bacteria, or other harmful bacteria, to grow under normal conditions in the area. If the sensors 75 detect that water has not flowed to those zones 50 in, for example, the seventy-five percent time frame, an alert may be sent to the user. Further, if a mode is elected by a user, the system may automatically flush the water 20 in that zone 50 and replace that water 20 with fresh water 20 to prevent the growth of the harmful bacteria.

By connecting and allowing the present system to automatically control a humidifier 75, the building may be a safer and more comfortable place. In particular, properly humidified air can effectively treat dryness and irritation of a person's skin, eyes, lips, nose and throat. Obtaining the proper level of humidity in a building can also promote good health and reduce flu and cold symptoms. The humidifier 705 may draw water from a cold-water source of the system, usually near a hot water tank.

In most systems, there is a solenoid valve which is activated when the furnace 701 turns on so that the desired, preset humidity level is obtained. The present system may allow a user to control the humidifier 705 through the main control panel 10 or through a wireless device 225. If the solenoid valve fails, the system will automatically alert the user. In one embodiment, the system will automatically take action to control the humidifier 705 in the event the sensors 75 detect improper operation of the humidifier 705.

Finally, in an embodiment, the present control panel and system may be used in connection with a "dry system" control. More specifically, for buildings that have preexisting plumbing which is not capable of being redirected to a common control panel, in an embodiment of the present system, a control panel 10 and sensors 75 may still be utilized to control pipes 100 and to alert the user in the same manner as the control panel 10 of, for example, FIG. 1, wherein a portion of the pipes 100 do pass through the control panel 10. In this dry system, the sensors 75 are attached at or near the zone 50 or utilities (such as a toilet) and a signal is sent to the computerized device 500 of the control panel 10. If a predetermined event (such as a leak, or humidity hits a predetermined level, or water is stagnated) the sensors 75 will send a signal to the computerized device 500 which will then send an alert to the user and the user may then take action.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A plumbing distribution panel and control system comprising:

a control panel having an interior wherein the control panel is connected to a building;

a first pipe passing through the interior of the control panel;

a second pipe passing through the interior of the control panel;

a first valve controlling the flow of liquid through the first pipe and a second valve controlling the flow of liquid through the second pipe and wherein the first valve and the second valve are both located within the interior of the control panel;

wherein a user can independently control the flow of water to different locations within the building through the control panel;

a sensor in electrical communication with the control panel wherein the sensor automatically closes the first valve or the second valve or opens the first valve or the second valve upon the detection of a predetermined event;

wherein the control panel then sends an alert to a first computer; and wherein the liquid located within the first pipe or the second pipe is drained and fresh liquid is added back to the first pipe or the second pipe if the sensor determines that the liquid has not flowed for a predetermined amount of time set by the user.

2. The plumbing distribution panel and control system of claim 1 further comprising:

a door on the control panel and a locking mechanism on door of the control panel.

3. The plumbing distribution panel and control system of claim 1 wherein the first computer is located within the control panel wherein the first computer sends a signal to a second computer and wherein the second computer is located outside of the control panel.

4. The plumbing distribution panel and control system of claim 3 wherein the signal is in real-time.

5. The plumbing distribution panel and control system of claim 3 wherein the second computer is a cell phone.

6. The plumbing distribution panel and control system of claim 1 wherein the sensor detects if a pipe of the system is leaking.

7. The plumbing distribution panel and control system of claim 1 wherein the sensor detects the humidity level around the sensor and sends the electrical communication to the control panel.

8. The plumbing distribution panel and control system of claim 1 wherein the sensor automatically closes the first valve or the second valve or opens the first valve or second valve upon the detection of a predetermined event.

9. The plumbing distribution panel and control system of claim 1 further comprising:

a securing bracket used to secure the first pipe or the second pipe wherein the securing bracket incorporates the sensor and wherein the sensor detects an environmental condition.

10. The plumbing distribution panel and control system of claim 1 further comprising:

a pump connected to the first pipe or the second pipe wherein the pump drains the liquid in the first pipe or the second pipe.

11. The plumbing distribution panel and control system of claim 1 further comprising:

a light associated with the first pipe and a light located with the second pipe wherein the light associated with either the first light or the second light indicates if the first valve or the second valve is closed or open.

* * * * *